US012516899B2

(12) United States Patent
Spyche, Jr. et al.

(10) Patent No.: US 12,516,899 B2
(45) **Date of Patent: *Jan. 6, 2026**

(54) HYDRAULIC RECOIL DEVICE FOR HANDGUN APPLICATIONS

(71) Applicant: KYNTEC CORPORATION, Orchard Park, NY (US)

(72) Inventors: Gerald J. Spyche, Jr., Orchard Park, NY (US); Joseph A. Schoen, Clarence, NY (US); Dale J. Kawa, Akron, NY (US); Jacob Jon Spyche, Orchard Park, NY (US)

(73) Assignee: KYNTEC CORPORATION, Orchard Park, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/601,310

(22) Filed: Mar. 11, 2024

(65) Prior Publication Data

US 2024/0271894 A1 Aug. 15, 2024

Related U.S. Application Data

(63) Continuation of application No. 17/650,323, filed on Feb. 8, 2022, now Pat. No. 11,959,718.

(Continued)

(51) Int. Cl.
*F41A 3/86* (2006.01)
*F41A 3/94* (2006.01)

(52) U.S. Cl.
CPC ..... *F41A 3/94* (2013.01)

(58) Field of Classification Search
CPC ..... F41A 3/86; F41A 3/89; F41A 3/94
See application file for complete search history.

(56) References Cited

U.S. PATENT DOCUMENTS 836,502 A * 11/1906 Johnson ..... F41A 3/78 89/198
1,039,922 A * 10/1912 Frommer ..... F41A 3/82 89/178

(Continued)

OTHER PUBLICATIONS

Wilson Combat, "Shok-Buff® , Recoil Buffers, 1911, Package Of 6", https://shopwilsoncombat.com/Shok-Buff-Recoil-Buffers-1911-Package-of-6/productinfo/2B/, accessed May 10, 2022.

(Continued)

*Primary Examiner* — Derrick R Morgan
(74) *Attorney, Agent, or Firm* — Bond, Schoeneck & King, PLLC

(57) ABSTRACT

A hydraulic recoil device for a handgun or pistol is provided. The device includes a cylinder defining an interior hollow compartment having a first end and a second end. The device further includes a first resilient member; a piston assembly arranged adjacent to the first resilient member and at least partially within the cylinder, where the piston assembly includes a piston head, a piston rod, and a piston cap; an accumulator arranged within the cylinder; and a second resilient member outside of the cylinder. The piston assembly is configured to remove an initial jolt in a firing cycle with a hydraulic resistance and the second resilient member is configured to provide recoil reduction after the initial jolt in the firing cycle. A method of reducing recoil in a handgun or pistol is also provided.

20 Claims, 6 Drawing Sheets

Related U.S. Application Data

(60) Provisional application No. 63/175,834, filed on Apr. 16, 2021.

(56) References Cited

U.S. PATENT DOCUMENTS 1,351,141 A * 8/1920 Thompson ..... F41A 3/94 89/198
2,426,661 A * 9/1947 Anderson ..... F16F 7/09 267/134
2,504,958 A * 4/1950 Botts ..... F41A 25/14 89/44.01
3,204,531 A * 9/1965 Swieskowski ..... F41A 3/82 89/199
3,435,728 A * 4/1969 Miller ..... F41A 3/86 89/199
3,517,586 A * 6/1970 Stoner ..... F41A 19/33 89/198
3,682,040 A * 8/1972 Roy ..... F41A 19/15 89/196
3,696,706 A * 10/1972 Seidel ..... F41C 23/12 89/196
3,731,590 A * 5/1973 Zimmerman, Jr. ..... F41A 5/04 89/178
3,901,125 A * 8/1975 Raville ..... F41A 3/86 89/196
3,977,296 A * 8/1976 Silsby ..... F41A 3/94 89/198
4,031,808 A * 6/1977 Raville ..... F41A 3/86 89/163
4,057,003 A * 11/1977 Atchisson ..... F41A 9/68 89/142
4,150,819 A * 4/1979 Taylor ..... F16F 13/00 89/43.01
4,201,113 A * 5/1980 Seecamp ..... F41A 3/86 89/163
4,485,723 A * 12/1984 Sarony ..... F41A 3/86 89/198
4,667,566 A * 5/1987 Bosshard ..... F41A 25/10 89/44.01
4,907,489 A * 3/1990 Teague ..... F41A 21/488 89/196
5,127,310 A * 7/1992 Lishness ..... F41A 3/86 42/108
5,598,904 A * 2/1997 Spyche, Jr. ..... F16F 9/48 267/221
6,758,126 B1 * 7/2004 Houtsma ..... F41A 3/94 42/1.06
6,974,002 B2 * 12/2005 Heideman ..... F16F 9/466 188/287
7,131,367 B1 * 11/2006 Boerschig ..... F41A 3/70 42/1.06
7,493,845 B2 * 2/2009 Mantas ..... F41A 3/86 42/1.06
7,681,351 B2 3/2010 Bucholtz et al.
8,205,729 B2 * 6/2012 Miyasato ..... F16F 9/19 188/286
8,939,059 B2 * 1/2015 Coffman, II ..... F41A 3/80 89/44.01
9,080,823 B1 * 7/2015 Mantas ..... F41A 3/84
9,551,395 B2 * 1/2017 Fujihara ..... F16F 9/003
10,100,896 B2 * 10/2018 Spyche, Jr. ..... F16F 13/007
10,712,108 B2 * 7/2020 Cozad ..... F41A 3/84
12,196,515 B1 * 1/2025 Mantas ..... F41A 25/12
2004/0182662 A1 * 9/2004 Heideman ..... F16F 9/466 188/286
2005/0257413 A1 * 11/2005 Zimmermann ..... F42B 5/025 42/75.1
2006/0236853 A1 * 10/2006 Boersching ..... F41A 3/70 89/198
2007/0234897 A1 * 10/2007 Poff, Jr. ..... F41A 3/94 89/198
2009/0001636 A1 * 1/2009 Miyasato ..... F16F 9/346 267/64.13
2010/0140031 A1 * 6/2010 Miyasato ..... F16F 9/19 188/280
2012/0085225 A1 * 4/2012 Vanek ..... F41A 5/06 89/163
2014/0026745 A1 * 1/2014 Lee ..... F41A 3/78 89/198
2017/0130799 A1 * 5/2017 Spyche, Jr. ..... F41A 3/90
2018/0010870 A1 * 1/2018 Mantas ..... F41A 3/86
2019/0234698 A1 * 8/2019 Weinland ..... F41A 25/02
2019/0293379 A1 * 9/2019 Taylor ..... F41A 25/12
2021/0080216 A1 * 3/2021 Na ..... F41A 21/36
2022/0136787 A1 * 5/2022 Caudle ..... F41A 3/86 89/191.01
2023/0204311 A1 * 6/2023 Spyche, Jr. ..... F41A 3/94 89/198

OTHER PUBLICATIONS

Extended European Search Report for EP Application No. 22178776.5, dated Nov. 30, 2022, pp. 1-11.

* cited by examiner

HYDRAULIC RECOIL DEVICE FOR HANDGUN APPLICATIONS

CROSS-REFERENCE TO RELATED APPLICATIONS

This application is a continuation application of U.S. application Ser. No. 17/650,323, filed Feb. 8, 2022, and entitled "Hydraulic Recoil Device for Handgun Applications," and claims priority to U.S. Provisional Application No. 63/175,834, filed Apr. 16, 2021, and entitled "Hydraulic Recoil Device for Handgun Applications," the entireties of which are incorporated herein by reference.

FIELD OF THE DISCLOSURE

The present disclosure relates generally to firearms, especially to handguns or semi-automatic pistols, and more particularly to hydraulic systems and methods for reducing recoil and improving shock absorption in handgun or semi-automatic pistol applications.

BACKGROUND OF THE INVENTION

Conventional semi-automatic pistols or handguns use a guide rod and a standard recoil spring with sufficient force to offset the force of the blowback of a slide, and allow proper cycling of action. Typically, a pistol or handgun includes a frame that is configured in sliding engagement with a slide. A coil spring is typically arranged with its opposite ends contacting portions of the frame and slide, respectively, directly or indirectly. The coil spring is mounted on and guided by the guide rod. Pulling the trigger causes a firing pin or striker to move forward, striking a primer in a cartridge. Recoil from the fired cartridge forces the slide back at a high rate of speed relative to the frame. This initial jolt can cause muzzle rise and most of the felt recoil. The coil spring is compressed by the rearward movement of the slide along the guide rod. The coil spring slows the travel of the slide and provides some recoil reduction via spring force. An ejector pulls the spent cartridge from a chamber and ejects it from the pistol. The coil spring expands to return the slide to the forward position. The compressed coil spring has sufficient force to properly chamber the next round and lock the firearm into a battery position. As the slide returns forward, a fresh cartridge is taken from a magazine and inserted into the chamber to be fired.

To reduce the amount of felt recoil, others have provided progressive-based spring systems that include multiple springs. As the slide travels rearward and compresses the guided spring, these systems utilize multiple springs that have varying rates over the length of the travel instead of a single spring. The multiple springs provide a controlled rearward movement of the slide, and as such a reduction in felt recoil. However, these systems do not provide any damping, and undamped harmonics can occur through the systems. The undamped harmonics can cause instability and vibration. Additionally, the springs do not remove energy from the systems, rather the energy is transformed into spring potential energy which is then returned into the system when the handgun returns to the battery position.

There is a need for improved systems and methods for reducing muzzle rise, felt recoil, and other effects that are present when a round is fired from a handgun.

SUMMARY OF THE INVENTION

The present disclosure is directed generally to inventive devices, systems, and methods for reducing muzzle rise and felt recoil and improving shock absorption in handguns or pistols using hydraulics. Generally, embodiments of the present disclosure are directed to devices, systems, and methods that feature a multi-staged recoil reduction mechanism. Applicant has recognized and appreciated that hydraulics can be used to take the initial jolt out of the firing cycle, as that is where a majority of the recoil is generated and where the velocities are highest. As the slide of the handgun or pistol continues rearward after the initial jolt, an outer resilient member can be activated to reduce the speed of the slide. Thus, the multi-staged recoil reduction mechanism contemplated herein can be achieved with hydraulics in a first stage and thereafter with an outer resilient member in a second stage. The multi-staged recoil reduction mechanism also provides damping to improve system stability and removes energy rather than recycling the energy as spring potential energy. Although the hydraulic recoil device contemplated herein is described and depicted with reference to a handgun or pistol, it should be appreciated that the hydraulic recoil device can be used with any suitable firearm or any non-firearm machine or system.

Generally, in an aspect a hydraulic recoil device for a handgun is provided. The hydraulic recoil device includes a cylinder defining an interior hollow compartment, the cylinder having first and second ends. The hydraulic recoil device further includes a first resilient member arranged completely within the cylinder; a piston assembly arranged adjacent to the first resilient member and at least partially within the cylinder, the piston assembly comprising a piston head, a piston rod extending from the piston head through the second end of the cylinder, and a piston cap opposite the piston head; an accumulator arranged within the cylinder; and a second resilient member arranged outside of the cylinder. The second resilient member extends between the first and second ends of the cylinder. The piston assembly is configured to remove an initial jolt in a firing cycle with a hydraulic resistance and the second resilient member is configured to provide recoil reduction after the initial jolt in the firing cycle.

In embodiments, the first and second resilient members are configured to provide preload and return the hydraulic recoil device to a battery position.

In embodiments, when the hydraulic recoil device is in a battery position in the handgun a length of the second resilient member is equal to or less than a length of the cylinder.

In embodiments, the hydraulic recoil device further includes an extension extending radially outward at the first end of the cylinder opposite the piston cap of the piston assembly. The second resilient member extends between the extension and the second end of the cylinder in embodiments.

In embodiments, the second resilient member is arranged coaxially with the first resilient member.

In embodiments, the accumulator is movable with the piston head of the piston assembly.

In embodiments, the accumulator is immovable relative to the piston head of the piston assembly.

In embodiments, when the piston rod is displaced in operation, the accumulator collects a damping medium from the interior hollow compartment through at least one opening in the piston head.

In embodiments, when the piston rod is displaced in operation, the accumulator collects a damping medium from the interior hollow compartment through a pathway between an interior surface of the cylinder and a surface of a bearing.

Generally, in another aspect a method of reducing recoil in a handgun is provided. The method includes providing a hydraulic recoil device comprising a cylinder defining an interior hollow compartment, the cylinder having first and second ends. The hydraulic recoil device further includes a first resilient member completely within the cylinder; a piston assembly arranged adjacent to the first resilient member and at least partially within the cylinder, the piston assembly having a piston head, a piston rod extending from the piston head through the second end of the cylinder, and a piston cap opposite the piston head; and an accumulator within the cylinder. The hydraulic recoil device further includes a second resilient member arranged outside of the cylinder where the second resilient member extends between the first and second ends of the cylinder. The method further includes generating a hydraulic resistance with the piston assembly to remove an initial jolt in a firing cycle and generating additional recoil reduction with the second resilient member after the initial jolt in the firing cycle.

In embodiments, the method further includes providing a bushing at the first end of the cylinder, and sliding the bushing and the second resilient member relative to an exterior surface of the cylinder during the firing cycle. The sliding of the bushing and the second resilient member are relative to a slide or a frame of the handgun in embodiments. In embodiments, the method further includes providing an outward extension extending radially outward at the first end of the cylinder opposite the piston cap of the piston assembly and the bushing is in contact with the outward extension in a battery position of the handgun. The second resilient member extends between the outward extension and the second end of the cylinder in embodiments. In further embodiments, the method further includes providing an inward extension of the cylinder, the inward extension extending radially inward at the first end of the cylinder opposite the piston cap of the piston assembly, and the inward extension is arranged coaxially with the outward extension.

In embodiments, the first and second resilient members are configured to provide preload and return the hydraulic recoil device to a battery position.

In embodiments, when the hydraulic recoil device is in a battery position in the handgun a length of the second resilient member is equal to or less than a length of the cylinder.

In embodiments, the second resilient member is arranged coaxially with the first resilient member.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The foregoing will be apparent from the following more particular description of example embodiments of the present disclosure, as illustrated in the accompanying drawings in which like reference characters refer to the same parts throughout the different views. The drawings are not necessarily to scale, emphasis instead being placed upon illustrating embodiments of the present disclosure.

DETAILED DESCRIPTION

A description of example embodiments of the invention follows. The example embodiments include a hydraulic accumulator and piston assembly within a recoil buffer or a shock absorber of a handgun or pistol. The example embodiments further include a resilient member within the hydraulic recoil reduction device to provide additional recoil reduction and not merely for return purposes. The example embodiments provide linear proportional accumulation that prevents dynamic pressure pulses and other harmonics that exist with conventional non-proportional internal accumulation. The improved damping provided by the hydraulic recoil reduction device disclosed herein allows for reduction in felt recoil, faster target acquisition, reduced wear and tear on internal components, and increased stability of the handgun in use. The example embodiments also provide a completely contained multi-staged recoil reduction system in a handgun that is capable of operating with a variety of orifice, accumulator, and damping technologies.

Figure 1:
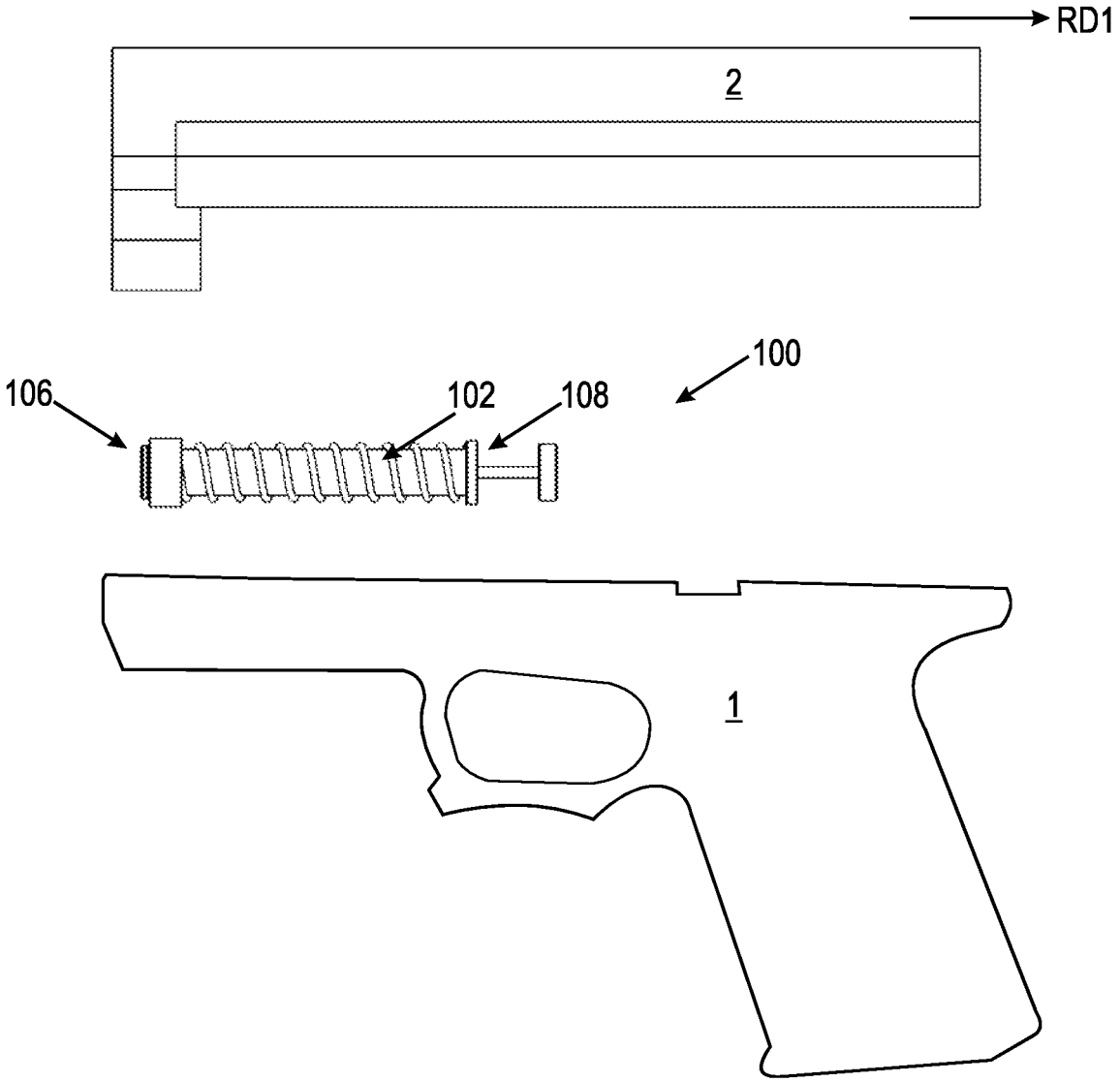
FIG. 1 is a schematic exploded elevational view of a semi-automatic handgun or pistol having a frame, a slide, and a hydraulic recoil device, in accordance with aspects of the present disclosure.

Referring now to the drawings, wherein like reference numerals refer to like parts throughout, there is shown in FIG. 1 a schematic exploded elevational view of a frame 1, a slide 2, and a hydraulic recoil reduction device 100 of a semi-automatic handgun or pistol. The hydraulic recoil reduction device 100 is designed to reduce muzzle rise, felt recoil, and other effects that are present when a round is fired using a multi-staged mechanism as described herein. The hydraulic recoil reduction device 100 provides an interface between the frame 1 and the slide 2. In embodiments, device 100 is placed inside slide 2 and one end of device 100 abuts slide 2 while the other end of device 100 abuts the frame 1. It should be appreciated that any intermediary component can be included between device 100 and slide 2 and/or between device 100 and frame 1. When the pistol is fired, the slide 2 is driven rearward relative to frame 1 in direction RD1. The hydraulic recoil reduction device 100 generates a hydraulic resistance to remove the initial jolt from the firing cycle. As slide 2 is driven further in the rearward direction RD1 relative to frame 1, a resilient member, such as, a spring, activates and reduces the speed of slide 2. The hydraulic recoil device 100 includes a cylinder 102 that defines an interior hollow compartment 104 (shown in FIGS. 2 and 3). The cylinder 102 and interior hollow compartment 104 include a distal end 106, a proximal end 108, and a continuous diameter between the distal end 106 and the proximal end 108. Cylinder 102 is preferably made of carbon steel however, it should be appreciated that cylinder 102 can also be made of stainless steel, aluminum, steel, aluminum alloys, composite, or any combination thereof. It should further be appreciated that cylinder 102 can be made of any other suitable materials. Although the barrel, trigger, magazine, and other components are not depicted in FIG. 1, it should be appreciated that these components are contemplated yet not necessary for a complete understanding of the invention. Barrel 3 is shown in FIGS. 2 and 3.

Figure 2:
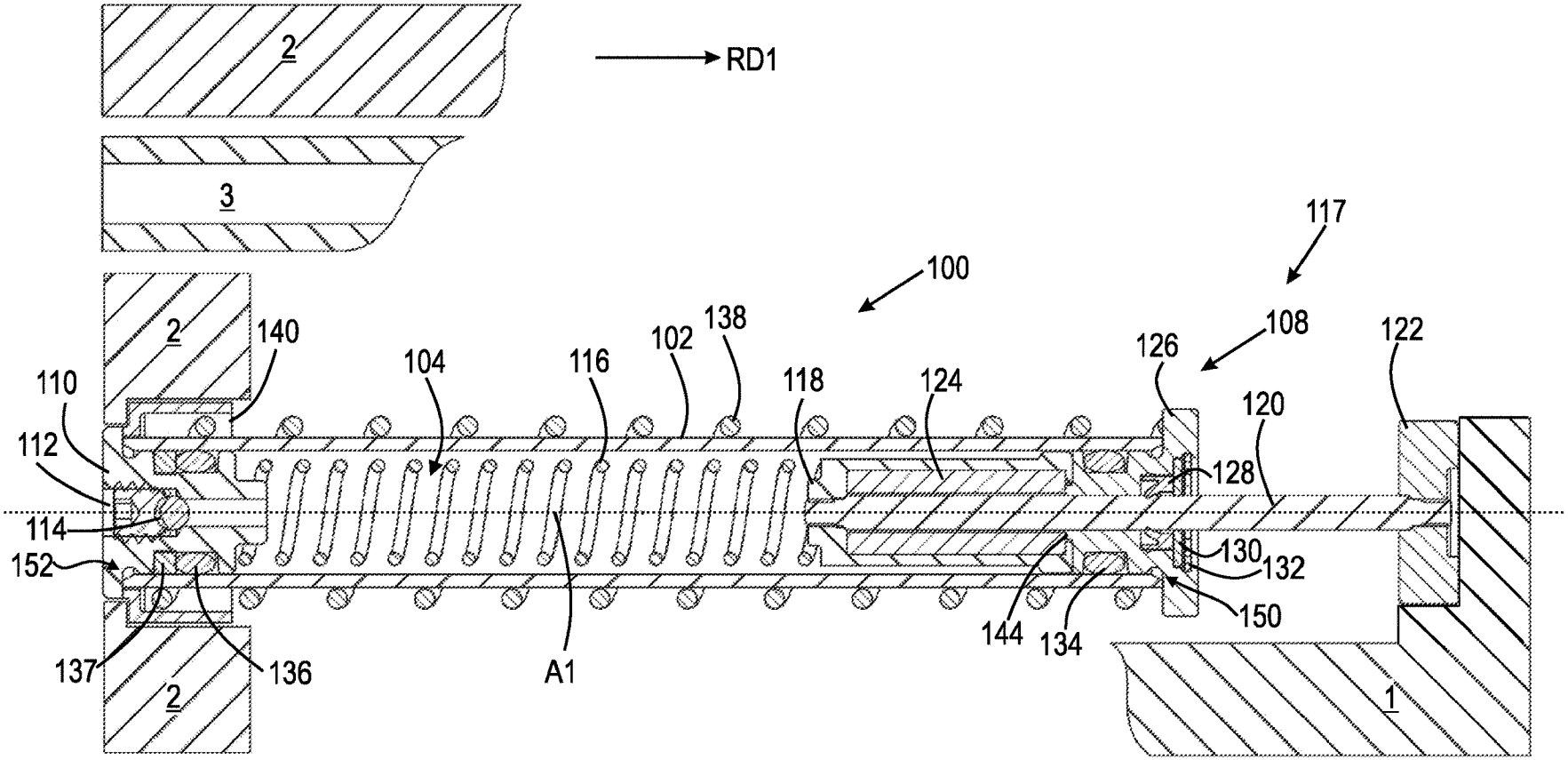
FIG. 2 is a schematic longitudinal cross-sectional view of a first embodiment of a hydraulic recoil device, in accordance with aspects of the present disclosure.
Figure 3:
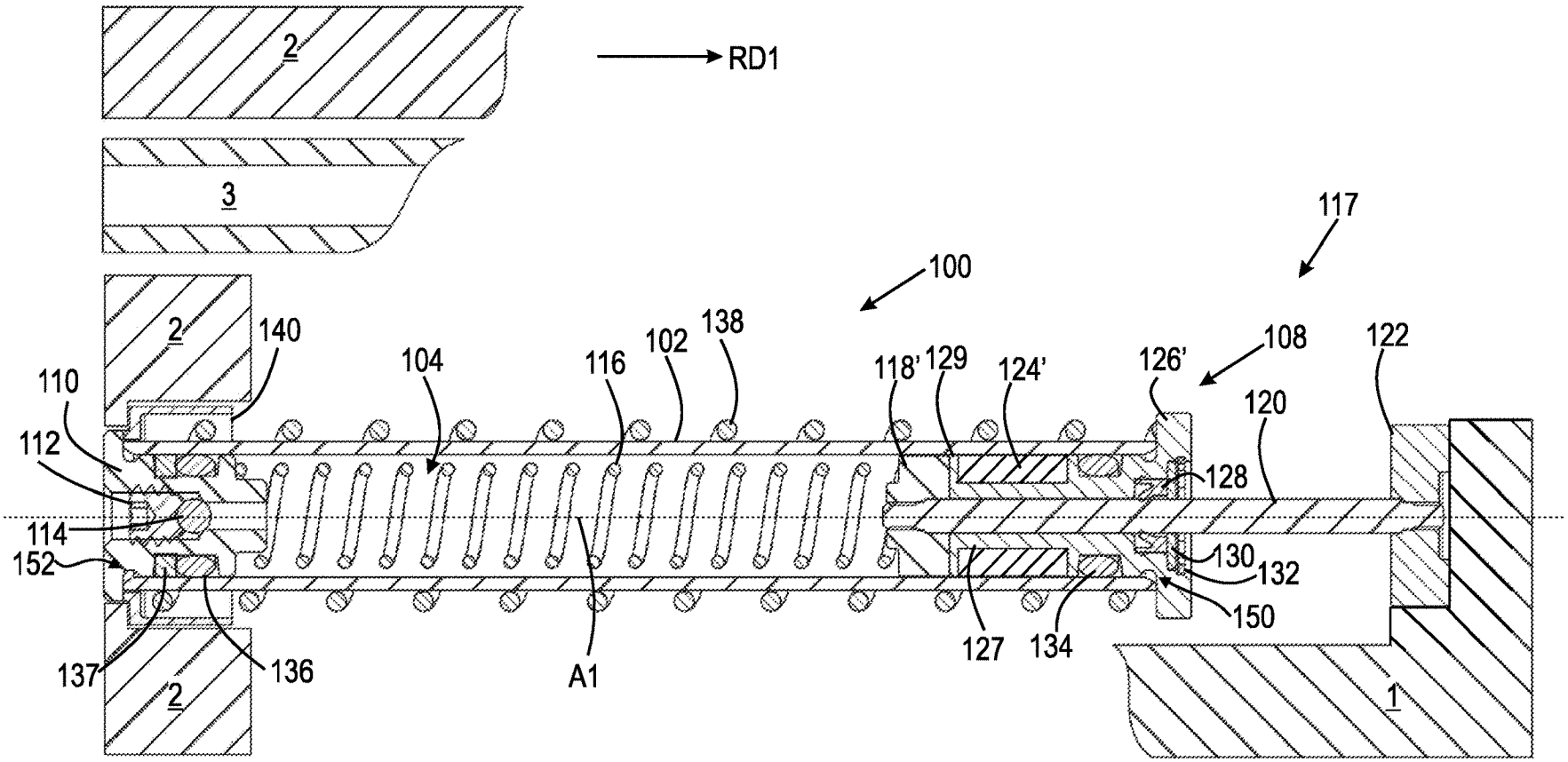
FIG. 3 is a schematic longitudinal cross-sectional view of a second embodiment of a hydraulic recoil device, in accordance with aspects of the present disclosure.

Referring to FIGS. 2 and 3, cylinder extension 110 is provided at the distal end 106 of the cylinder 102 with set screw 112 and hardened ball 114 to close the distal end 106 of cylinder 102. Ball 114 is preferably made of steel however, it should be appreciated that ball 114 can also be made of stainless steel, steel alloys, or any combination thereof. It should further be appreciated that ball 114 can be made of any other suitable materials. Cylinder extension 110 is preferably made of steel however, it should be appreciated that cylinder extension 110 can also be made of stainless steel, aluminum, steel or aluminum alloys, plastics, or any combination thereof. It should further be appreciated that cylinder extension 110 can be made of any other suitable materials. A resilient member 116, such as, a spring, is arranged within or inside cylinder 102 between cylinder extension 110 and piston assembly 117. Resilient member 116 is preferably made of steel however, it should be appreciated that resilient member 116 can also be made of plated steel, stainless steel, or any combination thereof. It should further be appreciated that resilient member 116 can be made of any other suitable materials.

Piston assembly 117 includes piston head 118, piston rod 120, and piston cap 122. In FIGS. 2 and 3, piston head 118 is connected to piston rod 120 and piston rod 120 is connected to piston cap 122 that is exterior to cylinder 102. Piston rod 120 extends from piston head 118 through the proximal end 108 of cylinder 102 to piston cap 122. Piston head 118 and piston rod 120 are slidably retained within or inside the cylinder 102. Piston head 118 is preferably made of brass however, it should be appreciated that piston head 118 can also be made of bronze, stainless steel, steel, aluminum, aluminum or steel alloys, or any combination thereof. It should further be appreciated that piston head 118 can be made of any other suitable materials. Piston rod 120 is preferably made of stainless steel however, it should be appreciated that piston rod 120 can also be made of aluminum, steel or aluminum alloys, or any combination thereof. It should further be appreciated that piston rod 120 can be made of any other suitable materials. Piston cap 122 is preferably made of stainless steel however, it should be appreciated that piston cap 122 can also be made of aluminum, steel or aluminum alloys, or any combination thereof. It should further be appreciated that piston cap 122 can be made of any other suitable materials.

An inertial compressible accumulator 124 is arranged within or inside the cylinder 102 to collect fluid from interior hollow compartment 104 that is displaced by the piston rod 120 when piston rod 120 slides toward the distal end 106 of the cylinder 102 and the piston rod 120 is introduced into the interior hollow compartment 104 of cylinder 102. An accumulating component is required to prevent the device from hydraulically locking because the closed space of the interior hollow compartment 104 would not otherwise be capable of accepting the additional volume of the piston rod 120 when the portion of the piston rod 120 that was outside of the cylinder 102 is introduced into the cylinder 102. An accumulating component can be made of a closed-cell foam containing gas within the foam that can compress, unlike hydraulic fluid. In embodiments, an accumulating component can include a compressible liquid instead. The fluid within or inside interior hollow compartment 104 is preferably a suitable military-specification hydraulic oil however, it should be appreciated that the fluid can also be silicone, any other suitable damping alternative, or any combination thereof. Thus, the hydraulic recoil device 100 can include any suitable damping medium. In embodiments, the military-specification hydraulic oil is a highly-refined mineral-based oil derived from crude that has an iso viscosity level of 15 and is thin compared to other oils so it can flow at a colder temperature. One such suitable hydraulic oil is MIL-H-5606.

Fluid from interior hollow compartment 104 or any suitable damping medium can flow through one or more openings in piston head 118. Additionally or alternatively, the damping medium from interior hollow compartment 104 can flow through an annular opening within piston head 118 or formed between piston head 118 and the interior surface of cylinder 102. Any suitable orifice technology is contemplated.

Bearing 126 is provided within the proximal end 108 of cylinder 102 to support the piston assembly 117. Piston rod 120 is configured to slide within an opening in bearing 126. Rod seal 128 is provided within or inside bearing 126 and around piston rod 120. Wiper seal 130 is also provided within or inside bearing 126 and around piston rod 120. Retaining ring 132 can also be provided within or inside bearing 126 and around piston rod 120. Seals 134 and 136 and backup ring 137 of cylinder 102 help enable device 100 to maintain the fluid within cylinder 102. Seals 134 and 136 can be o-ring seals or any suitable alternative. The o-ring seals are preferably made of a synthetic rubber material, such as Buna-N also known as nitrile or NBR, however, it should be appreciated that the o-ring seals can also be made of a fluoropolymer elastomer, such as, Viton™, natural rubber, other elastomers, or any combination thereof. It should further be appreciated that o-ring seals 134 and 136 can be made of any other suitable materials. Backup ring 137 is preferably made of any one or more suitable plastics. Rod seal 128 is preferably made of rubber however, it should be appreciated that rod seal 128 can also be made of any other suitable elastomers or any combination thereof. Wiper seal 130 is preferably made of any one or more suitable plastics. Retaining ring 132 is preferably made of spring steel however, it should be appreciated that retaining ring 132 can also be made of stainless steel, any other suitable materials, or any combination thereof. Bearing 126 is preferably made of brass however, it should be appreciated that bearing 126 can also be made of bronze, any other suitable materials, or any combination thereof.

The bearing 126 includes a groove, a seat, or any other suitable element to receive an end of resilient member 138. The other end of resilient member 138 is received in guide bushing 140 at a groove, a seat, or any other suitable element. Guide bushing 140 is slidable relative to an exterior surface of cylinder 102. The exterior of guide bushing 14 is nested into slide 2 by any suitable means. In other words, guide bushing 140 is secured within or inside slide 2. As described herein, when slide 2 travels rearward relative to the frame 1, guide bushing 140 and the end of resilient member 138 within or inside guide busing 140 also travel rearward relative to the frame 1 along the exterior surface of cylinder 102. Guide bushing 140 is preferably made of steel however, it should be appreciated that bushing 140 can also be made of stainless steel, aluminum, steel or aluminum alloys, plastics, or any combination thereof. It should further be appreciated that guide bushing 140 can be made of any other suitable materials.

Figure 4B:
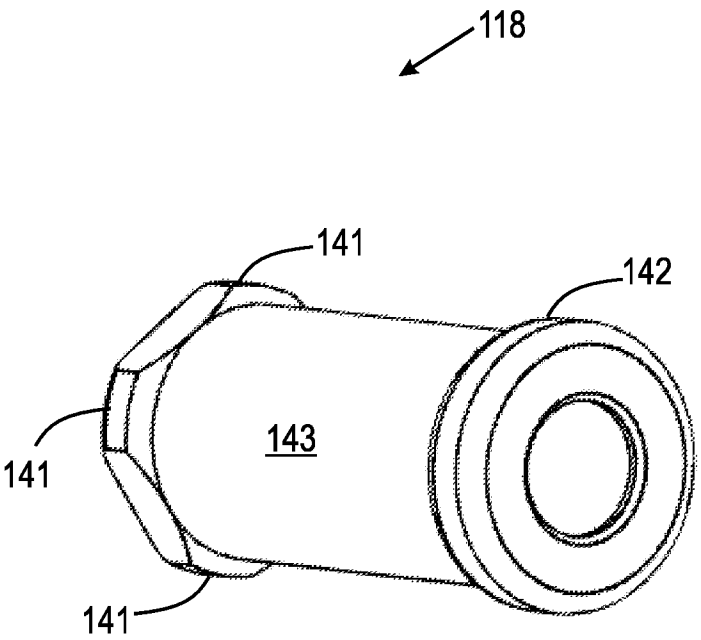
FIG. 4B is another schematic perspective view of the piston head of FIG. 4A, in accordance with aspects of the present disclosure.
Figure 4A:
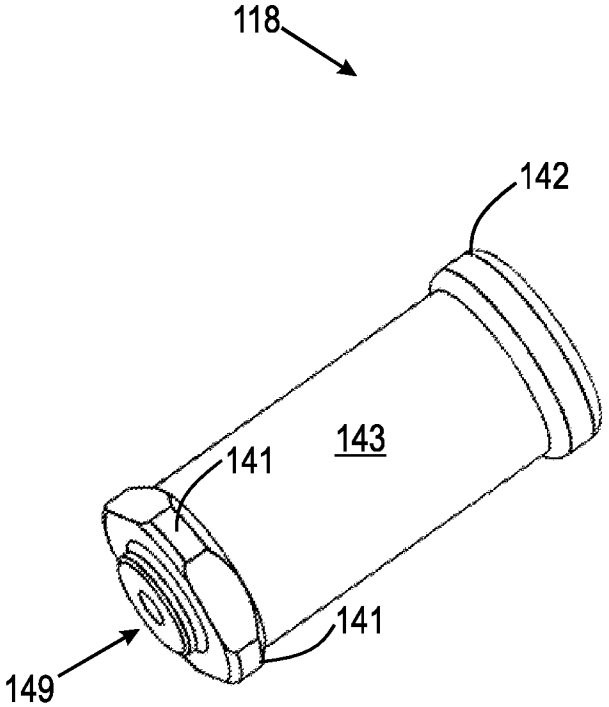
FIG. 4A is a schematic perspective view of a piston head, in accordance with aspects of the present disclosure.

In embodiments as shown in FIG. 2, the inertial accumulator 124 is movable along the longitudinal axis A1 of device 100 with piston head 118. Inertial accumulator 124 can be integrated or connected to piston head 118 and is configured to collect fluid from interior hollow compartment 104 that is displaced by the piston rod 120 when it slides toward the distal end 106 of the cylinder 102 and the piston rod 120 is introduced into the interior hollow compartment 104 of cylinder 102. As shown in FIGS. 4A and 4B, piston head 118 can include one or more sliding bearing surfaces 141 at the distal end of the piston head 118. Piston head 118 can also include an annular protrusion 142 at the proximal end of piston head 118 opposite the end with the one or more sliding bearing surfaces 141. The annular protrusion 142 can create an annular orifice between the protrusion 142 and an interior surface of cylinder 102. In embodiments, the annular orifice can embody various geometries to obtain a wide range of velocity power functions. It should further be appreciated that the annular protrusion 142 can be any suitable shape, for example, an annular depression.

Figure 5:
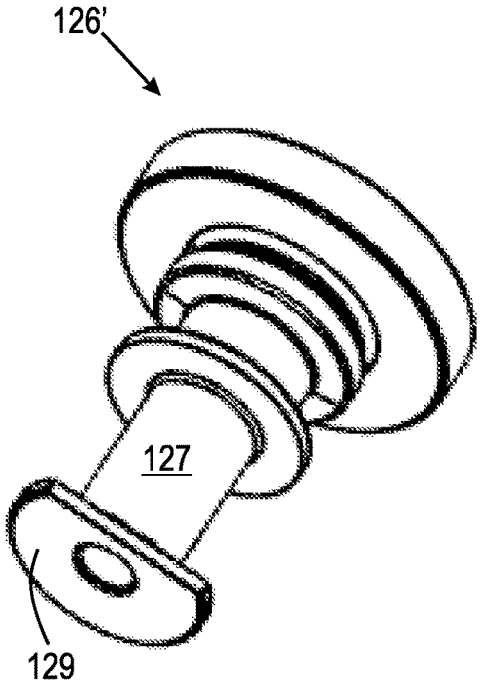
FIG. 5 is a schematic perspective view of a bearing from FIG. 3, in accordance with aspects of the present disclosure.

In embodiments as shown in FIG. 3, the inertial accumulator 124' is fixed. In such embodiments, inertial accumulator 124' is fixed in stationary bearing 126' and compensates for excess volume inside the cylinder 102 when piston rod 120 is introduced into cylinder 102. Bearing 126' is structurally similar to bearing 126 (shown in FIG. 2), except that bearing 126' includes a longitudinal extension 127 that is coaxial with piston rod 120 and a D-shaped axial member 129 that is positioned between piston head 118 and inertial accumulator 124'. FIG. 5 shows a schematic perspective view of bearing 126' including longitudinal extension 127 and D-shaped axial member 129. D-shaped axial member 129 helps ensure that bearing 126' is supported within or inside cylinder 102 while also allowing a path for fluid to be collected at the accumulator 124' from interior hollow compartment 104. While a D-shaped axial member is shown in the figures, it should be appreciated that any suitable alternative can be used to achieve the same functions. It should further be appreciated that it is preferred that longitudinal extension 127 and D-shaped axial member 129 are part of bearing 126' as a single piece of material made of brass, bronze, or any other suitable material(s).

Figure 6:
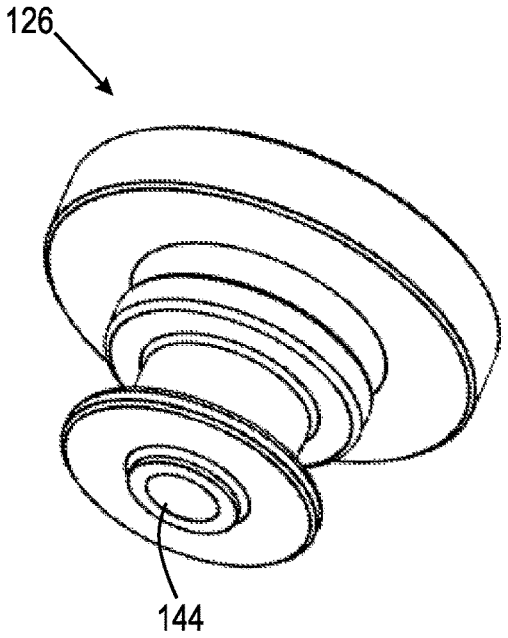
FIG. 6 is a schematic perspective view of a bearing from FIG. 2, in accordance with aspects of the present disclosure.

For comparison purposes, FIG. 6 shows a schematic perspective view of bearing 126 from FIG. 2. While bearing 126 does not include longitudinal extension 127 and D-shaped axial member 129, bearing 126 includes protrusion 144 that is configured to form a path between the piston rod 120 and the piston head 118. In embodiments, fluid from interior hollow compartment 104 flows between sliding bearing surfaces 141 of piston head 118 along an interior surface of cylinder 102, between the interior surface of cylinder 102 and longitudinally extending member 143, through the annular orifice created by annular protrusion 142 and an interior surface of cylinder 102, to the other side of the piston head 118 and to the accumulator 124 through one or more paths created by protrusion 144.

Figure 7:
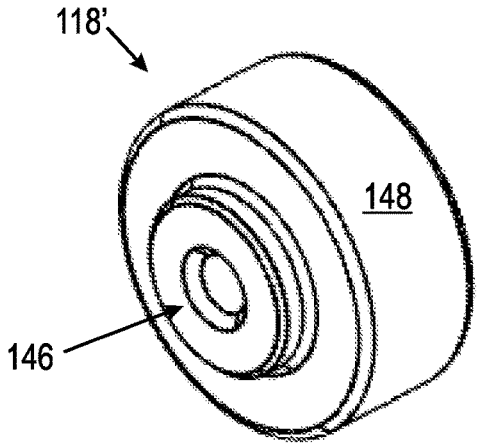
FIG. 7 is a schematic perspective view of a piston head from FIG. 3, in accordance with aspects of the present disclosure.

Additionally, in embodiments where the inertial accumulator 124' is not integrated or connected to the piston head to move (i.e., fixed), piston head 118' (shown in FIG. 3) is different from piston head 118 shown in FIG. 2. FIG. 7 shows a schematic perspective view of piston head 118' of FIG. 3. Unlike piston head 118 shown in FIGS. 2, 4A, and 4B that includes one or more sliding bearing surfaces 141, an annular protrusion 142, and a longitudinally extending member 143 connecting the sliding bearing surfaces and the annular protrusion, piston head 118' includes a central opening 146 to receive the distal end of the piston rod 120 and one or more openings to allow fluid from interior hollow compartment 104 to be collected within or inside accumulator 124'. In embodiments, an annular opening can be formed between the exterior surface 148 of piston head 118' and the interior surface of cylinder 102. In other embodiments, piston head 118' includes one or more openings within piston head 118'. Piston head 118 also includes central opening 149 to receive the distal end of the piston rod 120.

Regardless of whether inertial accumulator 124, 124' is movable or fixed, hydraulic recoil reduction device 100 advantageously provides linear proportional accumulation that prevents the dynamic pressure pulses and other harmonics that exist with standard non-proportional internal accumulation. Additionally, the hydraulic recoil reduction device 100 allows energy to be transformed into heat which is dissipated harmlessly and removed from the system.

Additionally, in all embodiments regardless of whether inertial accumulator 124, 124' is movable or fixed, it is preferred that during assembly cylinder 102 is deformed into one or more grooves 150 on bearing 126, 126' and one or more grooves 152 on cylinder extension 110. In other words, the ends of cylinder 102 are permanently deformed or altered to be joined with or otherwise connected to bearing 126, 126' and cylinder extension 110. This deformation or alteration during assembly generates a permanent bond so that cylinder 102 does not come apart from bearing 126, 126' and cylinder extension 110. In example embodiments, the ends of cylinder 102 are compressed together by rolling or swaging, for example, at grooves 150, 152. In other example embodiments, the ends of cylinder 102 can be otherwise pressed onto or into bearing 126, 126' and cylinder extension 110. In other example embodiments, the ends of cylinder 102 can include threading that mates with complementary threading on bearing 126, 126' and cylinder extension 110. Any suitable adhesives can be used as well. Of course, it is contemplated that any of these means of securement can be used in combination as well. Additionally, any other suitable means of securement are also contemplated.

In use, the hydraulic recoil reduction device 100 achieves a multi-staged recoil reduction as explained herein. When the trigger is pulled in a suitable handgun or pistol, a fired cartridge forces the slide 2 back at a high rate of speed relative to the frame 1 in rearward direction RD1. Hydraulic damping takes place as slide 2 is forced back initially. In embodiments, after slide 2 travels approximately 12.7 mm (or 0.500 inch) (i.e., to a first position), the outer resilient member 138 activates. As slide 2 continues to travel in the rearward direction RD1 (i.e., from the first position to a second position), slide 2 begins to slow down due to the compressed force from resilient member 138. Thus, hydraulic damping takes place in a first part of the stroke/cycle, and then the outer resilient member 138, such as, a spring, activates for the last part of the cycle. During the last part of the cycle, very little if any new recoil is generated. Applicant has recognized and appreciated that spring 138 is sufficient during the last part of the cycle without the hydraulic damping. If the hydraulic damping were present during the last part of the cycle, such hydraulics could prevent a new round from being chambered by slowing down slide 2 too much. In embodiments, the first part of the stroke/cycle can be a first half of the stroke/cycle and the last part of the stroke/cycle can be a last half of the stroke/cycle.

As described herein, resilient member 138 is not only provided for return purposes and provides additional recoil reduction once activated during the cycle. It should be appreciated that resilient member 138 should be strong enough to place the firearm back into battery position, but also balance the speed of the slide 2 during travel so that a round can be properly chambered. It should be appreciated that resilient member 138 is preferably made of steel however, it should further be appreciated that resilient member 138 can also be made of plated steel, stainless steel, or any combination thereof. It should also be appreciated that resilient member 138 can be made of any other suitable materials.

Moreover, while some conventional hydraulic buffers require an additional spring component to be purchased or on hand, hydraulic recoil reduction device 100 is a completely contained, drop-in system that does not require any additional components in order to properly fit and function in a suitable handgun or pistol.

Figure 8:
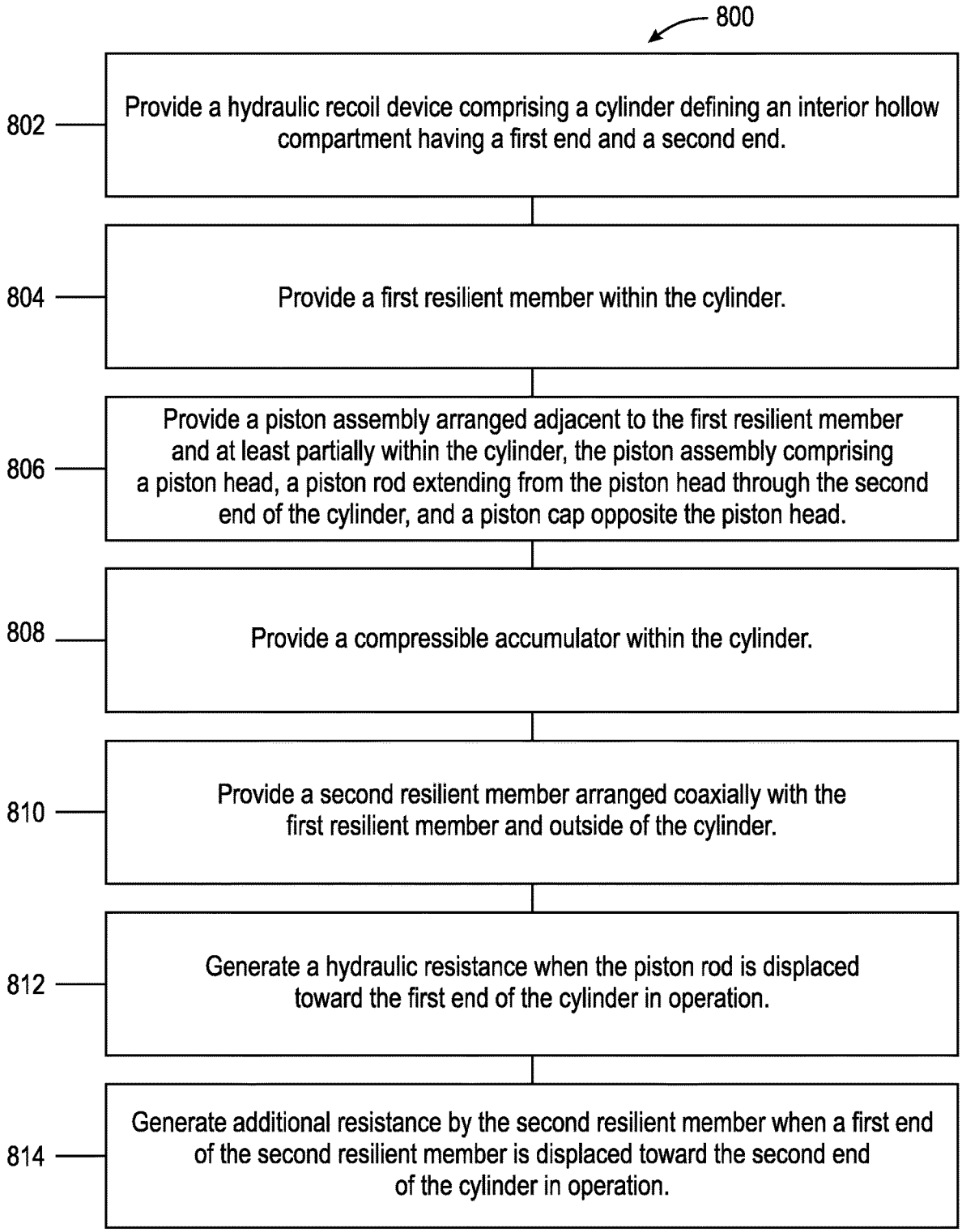
FIG. 8 is an example process for reducing recoil with a hydraulic recoil device in a semi-automatic handgun or pistol, in accordance with aspects of the present disclosure.

FIG. 8 shows an example process for reducing recoil with a hydraulic recoil device in a semi-automatic handgun or pistol.

At step 802, a hydraulic recoil device (i.e., device 100) is provided, the hydraulic recoil device including a cylinder mounted between a slide and a frame of a handgun or any suitable firearm or machine, the cylinder defining an interior hollow compartment having a first or distal end and a second or proximal end.

At step 804, a first resilient member is provided within or inside the cylinder (i.e., member 116).

At step 806, a piston assembly is provided (i.e., assembly 117). The piston assembly is arranged adjacent to the first resilient member and at least partially within or inside the cylinder. The piston assembly includes a piston head, a piston rod extending from the piston head through the second or proximal end of the cylinder, and a piston cap opposite the piston head.

At step 808, a compressible accumulator is provided within or inside the cylinder (i.e., accumulator 124, 124').

At step 810, a second resilient member is provided (i.e., member 138). The second resilient member is arranged coaxially with the first resilient member and outside of the cylinder.

At step 812, a hydraulic resistance is generated when the piston rod is displaced toward the first or distal end of the cylinder in operation.

At step 814, additional resistance is generated by the second resilient member when a first end of the second resilient member is activated when the first end of the second resilient member is displaced toward the second end of the cylinder. The second resilient member is activated when the slide is driven rearward from the first position to a second position to reduce a speed of the slide.

It should be understood that, unless clearly indicated to the contrary, in any methods claimed herein that include more than one step or act, the order of the steps or acts of the method is not necessarily limited to the order in which the steps or acts of the method are recited.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A hydraulic recoil device for a handgun, comprising:

a cylinder defining an interior hollow compartment, wherein the cylinder has first and second ends;

a first resilient member arranged completely within the cylinder;

a piston assembly arranged adjacent to the first resilient member and at least partially within the cylinder, the piston assembly comprising a piston head, a piston rod extending from the piston head through the second end of the cylinder, and a piston cap opposite the piston head;

an accumulator arranged within the cylinder; and a second resilient member arranged outside of the cylinder, wherein the second resilient member extends between the first and second ends of the cylinder and an uncompressed length of the second resilient member is equal to or less than a length of the cylinder;

wherein the piston assembly is configured to remove an initial jolt in a firing cycle with a hydraulic resistance and the second resilient member is configured to provide recoil reduction after the initial jolt in the firing cycle.

2. The hydraulic recoil device of claim 1, wherein the first and second resilient members are configured to provide preload and return the hydraulic recoil device to a battery position.

3. The hydraulic recoil device of claim 1, wherein when the hydraulic recoil device is in a battery position in the handgun a length of the second resilient member is equal to or less than a length of the cylinder.

4. The hydraulic recoil device of claim 1, further comprising an extension extending radially outward at the first end of the cylinder opposite the piston cap of the piston assembly.

5. The hydraulic recoil device of claim 4, wherein the second resilient member extends between the extension and the second end of the cylinder.

6. The hydraulic recoil device of claim 1, wherein the second resilient member is arranged coaxially with the first resilient member.

7. The hydraulic recoil device of claim 1, wherein the accumulator is movable with the piston head of the piston assembly.

8. The hydraulic recoil device of claim 1, wherein the accumulator is immovable relative to the piston head of the piston assembly.

9. The hydraulic recoil device of claim 1, wherein when the piston rod is displaced in operation, the accumulator collects a damping medium from the interior hollow compartment through at least one opening in the piston head.

10. The hydraulic recoil device of claim 1, wherein when the piston rod is displaced in operation, the accumulator collects a damping medium from the interior hollow compartment through a pathway between an interior surface of the cylinder and a surface of a bearing.

11. A method of reducing recoil in a handgun, comprising:

providing a hydraulic recoil device comprising a cylinder defining an interior hollow compartment, the interior hollow compartment having a first end and a second end, the hydraulic recoil device further comprising a first resilient member arranged completely within the cylinder, a piston assembly arranged adjacent to the first resilient member and at least partially within the cylinder, the piston assembly comprising a piston head, a piston rod extending from the piston head through the second end of the cylinder, a piston cap opposite the piston head, and an accumulator;

providing a second resilient member arranged outside of the cylinder, wherein the second resilient member extends between the first and second ends of the cylinder and an uncompressed length of the second resilient member is equal to or less than a length of the cylinder;

generating a hydraulic resistance with the piston assembly to remove an initial jolt in a firing cycle; and generating additional recoil reduction with the second resilient member after the initial jolt in the firing cycle.

12. The method of claim 11, further comprising providing a bushing at the first end of the cylinder, and sliding the bushing and the second resilient member relative to an exterior surface of the cylinder during the firing cycle.

13. The method of claim 12, wherein the sliding of the bushing and the second resilient member are relative to a slide or a frame of the handgun.

14. The method of claim 11, wherein the first and second resilient members are configured to provide preload and return the hydraulic recoil device to a battery position.

15. The method of claim 11, wherein when the hydraulic recoil device is in a battery position in the handgun a length of the second resilient member is equal to or less than a length of the cylinder.

16. The method of claim 12, further comprising providing an outward extension extending radially outward at the first end of the cylinder opposite the piston cap of the piston assembly and the bushing is in contact with the outward extension in a battery position of the handgun.

17. The method of claim 16, wherein the second resilient member extends between the outward extension and the second end of the cylinder.

18. The method of claim 16, further comprising providing an inward extension of the cylinder, the inward extension extending radially inward at the first end of the cylinder opposite the piston cap of the piston assembly, and wherein the inward extension is arranged coaxially with the outward extension.

19. The method of claim 11, wherein the second resilient member is arranged coaxially with the first resilient member.

20. The hydraulic recoil device of claim 1, wherein the length of the second resilient member is equal to or less than the length of the cylinder when the second resilient member is in an uncompressed state or when the hydraulic recoil device is in a battery position.

* * * * *